US006172556B1

(12) United States Patent
Prentice

(10) Patent No.: US 6,172,556 B1
(45) Date of Patent: Jan. 9, 2001

(54) FEEDBACK-CONTROLLED LOW VOLTAGE CURRENT SINK/SOURCE

(75) Inventor: John S. Prentice, Palm Bay, FL (US)

(73) Assignee: Intersil Corporation, Inc., Palm Bay, FL (US)

( * ) Notice: Under 35 U.S.C. 154(b), the term of this patent shall be extended for 0 days.

(21) Appl. No.: 09/261,981

(22) Filed: Mar. 4, 1999

(51) Int. Cl.[7] ..... G05F 1/10; G05F 3/02

(52) U.S. Cl. ..... 327/543

(58) Field of Search ..... 327/540, 541, 327/543, 538; 323/313, 315

(56) References Cited

U.S. PATENT DOCUMENTS 5,038,053 * 8/1991 Djenguerian et al. ..... 327/513
5,512,816 * 4/1996 Lambert ..... 323/315

* cited by examiner

*Primary Examiner*—Toan Tran
*Assistant Examiner*—Quan Tra
(74) *Attorney, Agent, or Firm*—Gary R. Stanford

(57) ABSTRACT

A low voltage MOSFET-configured current sink/source has an output node coupled to the drain of an output MOSFET, that is current mirror coupled with a diode-connected reference current MOSFET. The output MOSFET has its gate resistor-coupled to the gate of the reference current MOSFET and its drain coupled to the source a third $V_{GS}$-feedback control MOSFET of a feedback circuit, that includes a further current mirror circuit. This third MOSFET has its gate electrode coupled in common with the drain-gate connection of the reference current MOSFET. The $V_{GS}$-feedback control MOSFET is coupled with a further current mirror, the output of which is coupled to the gate-coupling resistor. In response to a drop in the drain-source voltage $V_{DS}$ of the output MOSFET so that the point that output MOSFET no longer operates in its saturation region, the $V_{GS}$-feedback control MOSFET turns on, causing the flow of drain current in the feedback control MOSFET. The further current mirror circuit mirrors this drain current through the gate-coupling resistor, causing a voltage drop across it, so that the value of gate-source voltage applied to the output MOSFET is increased. The effect of this increase in the value of $V_{GS}$ of the output MOSFET for a reduced value of its drain-source voltage $V_{DS}$ is to shift the knee or (saturation-linear) transition region of the output (drain-to-source) current $I_{DS}$ of the output MOSFET to a lower knee point, thereby reducing the amount of headroom voltage required of a given sink/source current at the output terminal.

21 Claims, 2 Drawing Sheets

| y | D |
|---|---|
| 0.9 | 0.011 |
| 0.8 | 0.048 |
| 0.7 | 0.118 |
| 0.6 | 0.230 |
| 0.5 | 0.400 |

TABLE 1
CURRENT PEAKING FACTOR VS. FRACTIONAL $V_{DS}$ RANGE EXTENSION

FEEDBACK-CONTROLLED LOW VOLTAGE CURRENT SINK/SOURCE

FIELD OF THE INVENTION

The present invention relates in general to circuits employed for the sinking/sourcing a reference current, and is particularly directed to a new and improved multi-transistor current interface circuit that is operative to increase the gate-source voltage of a current sink/supply output MOSFET, in response to a drop in drain-source voltage of the MOSFET, that would otherwise cause its operation to shift from a saturation region to a linear region of its drain-to-source current versus drain-source voltage characteristic. This increase in gate-source voltage of the output MOSFET effectively shifts the saturation-linear transition region to a lower drain-to-source voltage range, thereby reducing the amount of headroom voltage required of a given sink/source current at the output terminal.

BACKGROUND OF THE INVENTION

Bipolar, CMOS and biCMOS transistor current mirror circuits are widely used throughout the electronics industry to source or sink a current that is to be interfaced with one or more signal processing circuits of an integrated circuit architecture. For proper operation, a current interface circuit should ideally be insensitive to changes in its power supply voltage. This has been conventionally accomplished by making the voltage supply rail differential large enough to accommodate powering the integrated circuit of interest, and still leave sufficient voltage 'headroom' for the current supply/sink circuit, in the presence of some variation in the power supply's output.

Unfortunately for the circuit designer, the ongoing micro-miniaturization of electronic products, such as, but not limited to wireless communication circuits, has been and is expected to be continued to be accompanied by a reduction in the size of the power supply. This means that the circuit designer is faced with the task of obtaining the same or even more performance from a circuit that is to be powered by an ever shrinking supply voltage differential (e.g., currently on the order of two volts or less).

As a non-limiting example, in a communication signal processing application employing an IF amplifier circuit having a bipolar transistor configured peak detector input stage, the associated current sink (e.g., an N-channel MOSFET circuit) may forced to operate with an extremely low overhead voltage (dependent upon the IF amplifier's AGC setting), for example, on the order of less than 0.2 V at a low $V_{CC}$ supply rail value and low temperature, due to relatively large base-emitter voltages required of the peak detector circuit.

SUMMARY OF THE INVENTION

In accordance with the present invention, this problem is addressed by a new and improved low voltage MOSFET-configured current sink/source, that couples a gate-source voltage control feedback circuit in a feedback path with the output MOSFET of an output current mirror circuit. The feedback circuit includes a feedback control MOSFET that is coupled to the output MOSFET, and is turned on in response to a drop in drain-source voltage of the output MOSFET that would otherwise cause the output MOSFET to shift from its saturation region to its linear region of operation.

When the feedback MOSFET is turned on an associated feedback control current mirror circuit mirrors the drain current in the feedback control MOSFET through a gate-coupling resistor of the output current mirror circuit. This produces a voltage drop across the gate-coupling resistor that increases the gate-source voltage of the output MOSFET to a value that effectively shifts the saturation-linear transition region of the drain-to-source current versus drain-source voltage of the output MOSFET to a lower drain-to-source voltage range.

For the application of the invention as a current sink, the circuit's output node is coupled to the drain of the output MOSFET, which is coupled in a current mirror circuit configuration with a like channel polarity reference current MOSFET. The geometries of these two output current mirror MOSFETs are ratioed to achieve the desired current mirror effect in the output MOSFET. The current-sinking output MOSFET has its source electrode coupled to first (e.g., ground) power supply rail, and its gate electrode coupled through a voltage-dropping element (resistor) to the gate electrode of the reference current MOSFET. The source electrode of the reference current MOSFET is also coupled to the ground supply rail. The drain electrode of the reference current MOSFET is coupled in common (diode-connected) with its gate electrode and is further coupled to receive a reference current from a current source that is coupled in circuit with a second power supply rail ($V_{CC}$).

The drain electrode of the output MOSFET is further coupled to the source electrode of a third $V_{GS}$-feedback control device, e.g., a like polarity channel MOSFET contained within a feedback circuit that also includes a further current mirror circuit. This third MOSFET has its gate electrode coupled in common with the gate electrode of the reference current MOSFET. The $V_{GS}$ feedback control MOSFET has its drain electrode coupled to the commonly connected drain and gate of a fourth, opposite polarity channel MOSFET, which is connected in current mirror configuration with a fifth opposite polarity channel MOSFET of the feedback current mirror circuit.

Normally, the third $V_{GS}$-feedback control MOSFET is in its off state, since its $V_{GS}$ is less than its threshold voltage $V_{Th}$, and no reference current is supplied to or mirrored by the further current mirror circuit. Current flow through the feedback control MOSFET and thereby through the further current mirror circuit is initiated when the drain-source voltage $V_{DS}$ of the output MOSFET drops below its threshold voltage $V_{Th}$. Since there is no other gate current applied to either of the first and second MOSFETs, their gate-coupling resistor does not change the value of $V_{GS}$ of the output MOSFET.

The gate electrodes of the further current mirror's MOSFETs are connected in common, while their source electrodes are coupled to the second power supply rail. The drain electrode of the further current mirror's mirror MOSFET, which serves as the output current node of the further current mirror circuit, is coupled to the common connection of the gate-coupling resistor and the gate electrode of the output MOSFET. As will be described, the output current generated by the further current mirror circuit serves as a $V_{GS}$ feedback control current, by causing a voltage drop across the gate-coupling resistor, and thereby increases the gate-source voltage $V_{GS}$ of the output MOSFET in response to a drop in the drain-source voltage $V_{DS}$ of the output MOSFET.

Operation of the circuit is based upon relationships among various voltage and current relationships of a MOSFET, and the transition between the saturation and triode regions of a MOSFET when its drain-source voltage $V_{DS}$ satisfies the relationship $V_{DS}=V_{GS}-V_{Th}$, where $V_{GS}$ is its gate-source voltage, and $V_{Th}$ its threshold voltage. Since $V_{GD}=V_{GS}-V_{DS}$ then, then at the transition region or 'knee' in the output MOSFET's current–voltage characteristic, $V_{GD}=V_{Th}$. As the drain-source voltage $V_{DS}$ of the output MOSFET decreases to the point that output MOSFET is no longer in its saturation region, the $V_{GS}$-feedback control MOSFET begins to turn on, causing the flow of drain current in the feedback control MOSFET.

The current mirror circuit mirrors the drain current through the feedback MOSFET and applies this drain current through the gate-coupling resistor. This produces a voltage drop across the gate-coupling resistor, so that the value of gate-source voltage applied to the output MOSFET is modified (e.g., increased), since the $V_{GS}$ of the output MOSFET equals the sum of $V_{GS}$ of its associated mirror MOSFET and the voltage drop across the gate-coupling resistor.

The effect of this increase in the value of $V_{GS}$ of the output MOSFET for a reduced value of its drain-source voltage $V_{DS}$ is to shift the knee or (saturation-linear) transition region of the output (drain-to-source) current $I_{DS}$ of the output MOSFET to a lower knee point, thereby reducing the amount of headroom voltage required of a given sink/source current at the output terminal. Due to complex temperature coefficients of components through the feedback path, the gate-coupling resistor may be made temperature dependent, as well.

DETAILED DESCRIPTION

Figure 1:
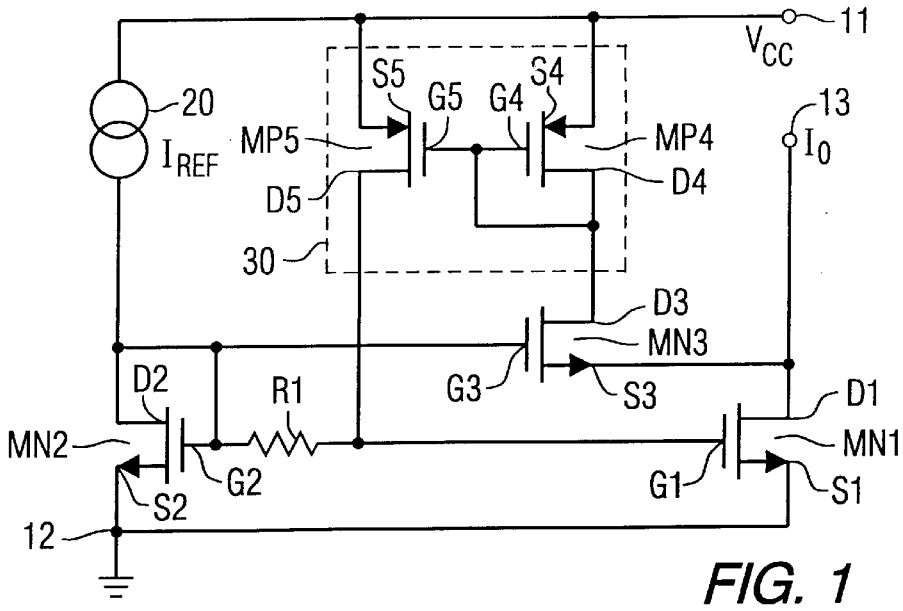
FIG. 1 is a schematic diagram of an embodiment of a low voltage MOSFET-configured current source in accordance with the present invention.

Attention is now directed to FIG. 1, which is a schematic diagram of an embodiment of a low voltage MOSFET-configured current source in accordance with the present invention. Although FIG. 1 shows and the present description details the invention from a standpoint of a low voltage current sink application using MOSFET components, it will be readily understood by those skilled in the art that the invention is equally applicable to the use of other functionally equivalent integrated circuit components, such as bipolar transistors, and its use for a complementary current flow application—a low voltage current source (with a corresponding substitution of complementary polarity devices—P-type for N-type and vice versa).

As shown in FIG. 1, for the low voltage current source application of the present embodiment, the circuitry of the present invention comprises first and second voltage terminals 11 and 12, which are coupled to respective voltage supply rails, such as $V_{CC}$ and ground (GND), as shown. The circuit further includes a current sink node 13 which, in the present embodiment of a current source, is coupled to an associated circuit, such as an amplifier or peak detector, referenced above as non-limiting examples, that source a current $I_0$ that is to be sinked by the low voltage current source of FIG. 1.

More particularly, current sink node 13 is coupled to the drain electrode D1 of a first N-channel, output MOSFET MN1, which is coupled in a current mirror circuit configuration with a second N-channel, reference current MOSFET MN2, where the geometry parameters of MOSFETs MN1 and MN2 are ratioed to achieve the desired current mirror effect in the output MOSFET MN1. For purposes of the present discussion, it will be assumed that MOSFETs MN1 and MN2 have equal geometries, and a third N-channel MOSFET MN3 preferably has a geometry less than that of MOSFETs MN1 and MN2.

Current sink output MOSFET MN1 has its source electrode S1 coupled to the ground supply terminal 12, and its gate electrode G1 coupled through a resistor R1 to the gate electrode G2 of the reference current MOSFET MN2. The source electrode S2 of reference current MOSFET MN2 is also coupled to the ground supply terminal 12. The drain electrode D2 of reference current MOSFET MN2, which is coupled in common with the gate electrode G2 of MOSFET MN2, is coupled to receive a reference current $I_{REF}$ from a current source 20, which is coupled in circuit with the $V_{CC}$ supply rail 11.

The drain electrode D1 of output MOSFET MN1 is further coupled to the source electrode S3 of a third N-channel, $V_{GS}$-feedback control MOSFET MN3, the gate electrode G3 of which is coupled in common with the gate electrode G2 of the reference current MOSFET MN2. The $V_{GS}$ feedback control MOSFET MN3 has its drain electrode D3 coupled to the commonly connected drain D4 and gate G4 of a fourth, P-channel MOSFET MP4, which is connected in current mirror configuration with a fifth, P-channel MOSFET MP5 of a current mirror circuit 30.

Normally, MOSFET MN3 is in its off state, since its $V_{GS}$ is less than its threshold voltage $V_{Th}$, and no reference current is supplied to or mirrored by the current mirror circuit 30. Current flow through the feedback control MOSFET MN3 (and thereby through the current mirror circuit 30) is initiated when the drain-source voltage $V_{DS1}$ of output MOSFET MN1 drops below its threshold voltage $V_{Th1}$. Since there is no other gate current applied to either of MOSFETs MN1 and MN2, resistor R1 does not change $V_{GS}$.

The gate electrodes G4 and G5 of respective current mirror MOSFETs MP4 and MP5 are connected in common, while their source electrodes S4 and S5 are coupled to the $V_{CC}$ supply rail. The drain electrode D5 of MOSFET MP5, which serves as the output current node of the current mirror circuit 30, is coupled to the common connection of resistor R1 and the gate electrode G1 of MOSFET MN1. As will be described, the output current generated by current mirror circuit 30 serves as a $V_{GS}$ feedback control current, by causing a voltage drop across resistor R1, and thereby increases the gate-source voltage $V_{GS1}$ of MOSFET MN1, in response to a drop in the drain-source voltage $V_{DS1}$ of the output MOSFET MN1. The voltage drop across resistor R1 may be established by the appropriate choice of the value of resistor R1 and the magnitude of the output current produced by current mirror circuit 30. The magnitude of the output current produced by current mirror circuit is readily determined by the tailoring the ratio of the geometry of P-channel MOSFET MP4 to that of P-channel MOSFET MP5.

Operation of the circuit of FIG. 1 will now be explained with reference to FIG. 2, which shows the $I_{DS}$ vs. $V_{DS}$ relationship of an N-channel MOSFET, and parametric relationships among the various circuit components of FIG. 1. In accordance with industry standard circuit models for evaluating the behavior of integrated circuit components, the transition between the saturation and triode regions of a MOSFET occurs when its drain-source voltage $V_{DS}$ satisfies the relationship set forth in equation (1) as follows:

$$V_{DS}=V_{GS}-V_{Th} \quad (1).$$

where $V_{GS}$ is its gate-source voltage, and $V_{Th}$ is its threshold voltage.

Figure 2:
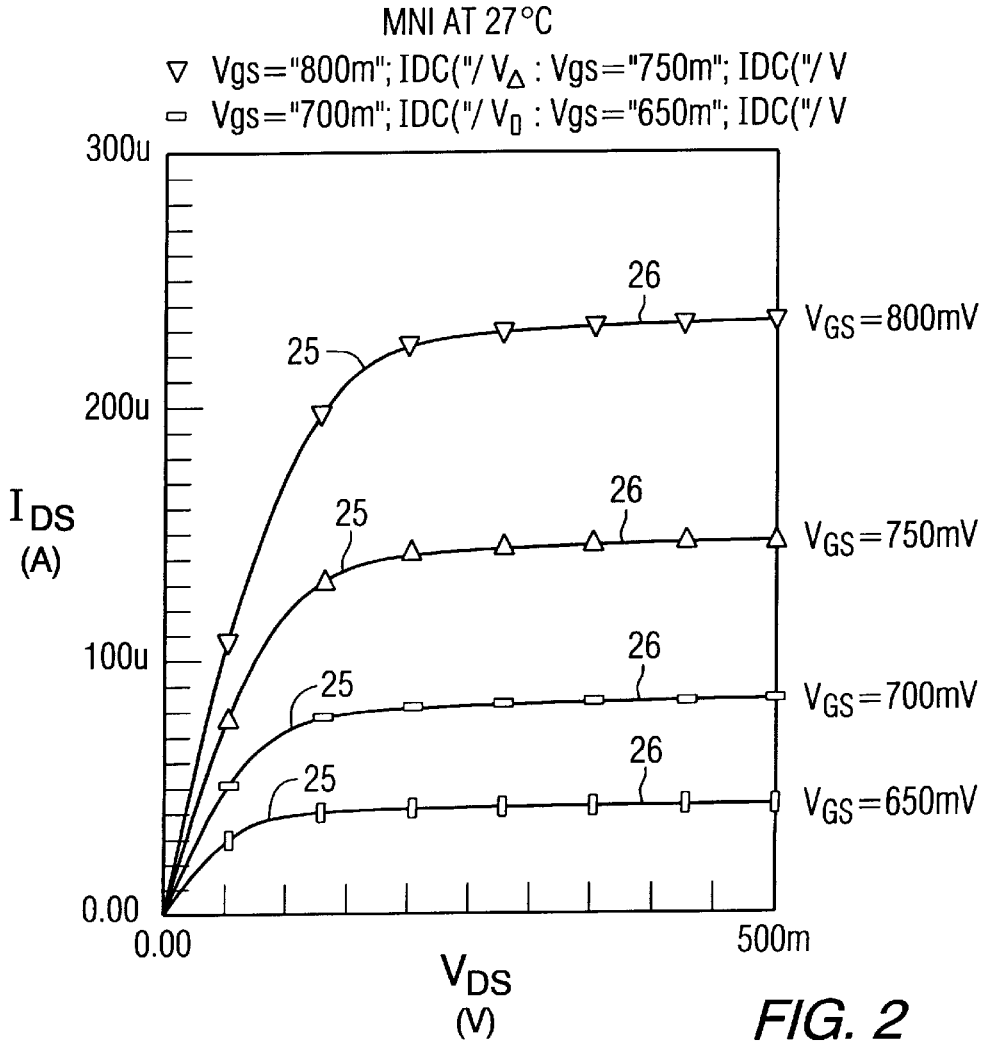
FIG. 2 shows the $I_{DS}$ vs. $V_{DS}$ relationship of an N-channel MOSFET.

However, since $V_{GD}=V_{GS}-V_{DS}$ then, at the transition region or 'knee' 25 in the current–voltage characteristics shown in FIG. 2, it follows that:

$$V_{GD}=V_{Th} \quad (2).$$

As the drain-source voltage $V_{DS1}$ of output MOSFET MN1 decreases to the point that output MOSFET MN1 is no longer in its saturation region 26, the N-channel, $V_{GS}$-feedback control MOSFET MN3 begins to turn on, causing the flow of drain(-source) current $I_{DS3}$. Current mirror circuit 30 mirrors (and ratios/scales) the drain current $I_{DS3}$ through MOSFET MN3 at the drain D5 of P-channel MOSFET and applies this drain current through resistor R1. As described above, this produces a voltage drop $V_{R1}$ across resistor R1, so that the value of $V_{GS1}$ is increased, as $V_{GS1}$ equals the sum Of $V_{GS2}$ and $V_{R1}$.

Figures 3, 4:
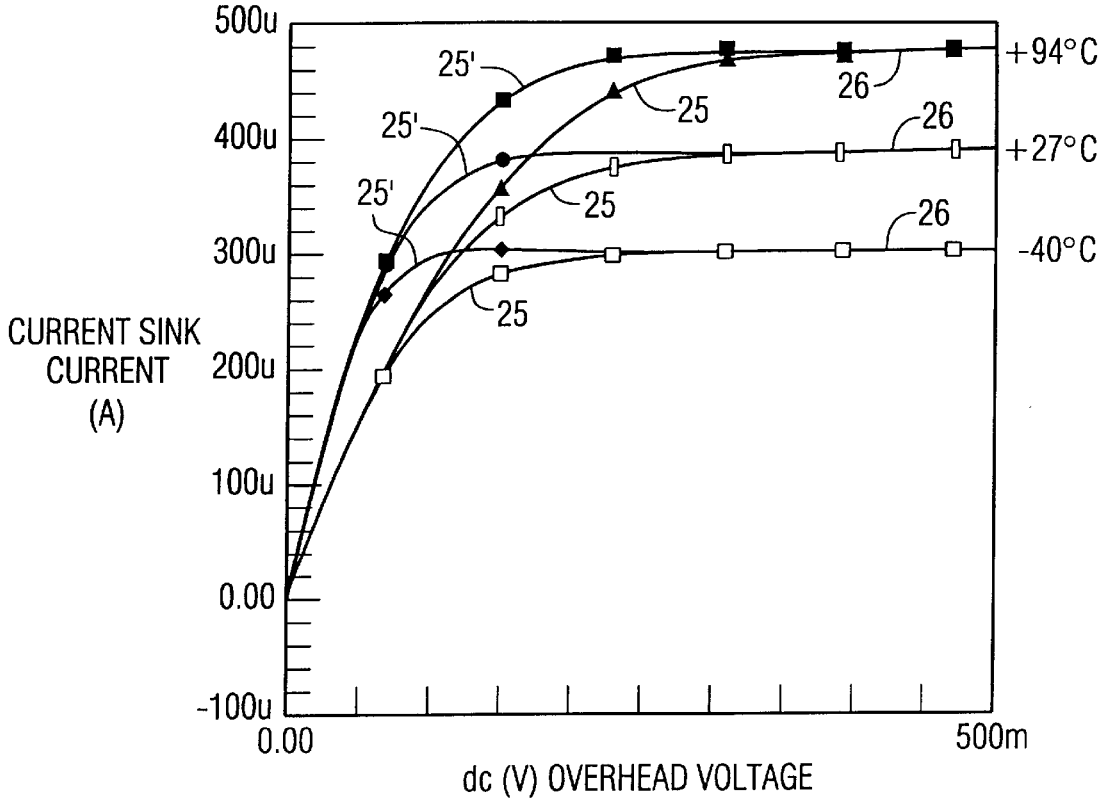
FIG. 3 shows the output current at the output node of the circuit of FIG. 1 for the case that the reference current is proportional to absolute current, and with transistors MN3, MP4 and MP5 removed and the gate of transistor MN1 directly connected to the gate of transistor MN2.
FIG. 4 contains a Table 1, which lists non-limiting values of current peaking factor and fractional $V_{DS}$ range extension parameters of the feedback circuit employed in the current sink/source of the present invention.

As can be seen from FIG. 3, which shows the $I_{DS}$ Vs. $V_{DS}$ relationship of an N-channel MOSFET, the effect of this increase in the value of $V_{GS1}$ for reduced $V_{DS1}$ is to shift the 'knee' 25 of the output (drain-source) current $I_{DS1}$ of MOSFET MN1 to a lower 'knee' point 25' along the $V_{DS}$ axis, thereby reducing the amount of headroom voltage required of a given sink/source current at output terminal 11. Fortunately, since the feedback MOSFET MN3 is a relatively small geometry device operating at a relatively small current, it degrades the current sink impedance only slightly. The impedance does drop as output MOSFET MN1 comes out of saturation.

In order to provide a thorough demonstration of the functionality and operation of the $V_{GS}$ controlling feedback MOSFET MN3 in the circuit of FIG. 1, the following detailed explanation is provided. It will be initially assumed that the output MOSFET MN1 is operating in its triode (linear) region (below saturation), and that the feedback MOSFET MN3 is operating in its saturation region. In this circumstance, the drain current $I_{DS1}$ of output MOSFET MN1 is given in equation (3) as:

$$I_{DS1}=k_1[2(V_{GS1}-V_{Th})V_{DS1}-(V_{DS1})^2] \quad (3)$$

The drain current $I_{DS3}$ and gate-source voltage $V_{GS3}$ of feedback MOSFET MN3 are given in equations (4) and (5) respectively as:

$$I_{DS3}=k_3(V_{GS3}-V_{Th})^2=k_3(V_{GS2}-V_{DS1}-V_{Th})^2 \quad (4)$$

$$V_{GS3}=V_{GS2}-V_{DS1} \quad (5)$$

In equations (4) and (5), the subscripted k variables are MOSFET conduction parameters (sometimes called β or k-prime). The value k may be defined in equation (6) as follows:

$$k \equiv \mu_{eff} C_{ox} \frac{W}{L} \quad (6)$$

After separating out all the terms that contain $V_{DS1}$, equation (4) may be rewritten as:

$$I_{DS3}=k_3(V_{GS2}-V_{Th})^2-k_3[2(V_{GS2}-V_{Th})-V_{DS1}]V_{DS1} \quad (7)$$

As pointed out above, the gate-source voltage $V_{GS1}$ of output MOSFET MN1 is the sum of the gate-source voltage $V_{GS2}$ of the (diode connected) MOSFET MN2 plus the IR voltage drop $V_{R1}$ across resistor R1. If the P-channel current mirror transistor MP5 is sized so as to scale up the input current, the resistor R1 will have a smaller value. Assuming a 1:1 geometry current mirror circuit, then $$V_{GS1}=V_{GS2}+R1I_{DS3}=V_{GS2}+K(V_{GS3}-V_{Th})^2 \quad (8)$$

where K is defined as R1$k_3$, and $$V_{GS1}=V_{GS2}+K(V_{GS2}-V_{Th})^2-K[2(V_{GS2}-V_{Th})-V_{DS1}]V_{DS1} \quad (9)$$

Subtracting $V_{Th}$ from both sides of equation (9) yields:

$$V_{GS1}-V_{Th}=(V_{GS2}-V_{Th})+K(V_{GS2}-V_{Th})^2-K[2(V_{GS2}-V_{Th})-V_{DS1}]V_{DS1} \quad (10)$$

The value of $V_{DS1}$ that marks the transition between the triode and saturation resistance without feedback from MOSFET MN3 is defined in equation (11) as:

$$V_{DS0}=V_{GS2}-V_{Th} \quad (11)$$

where $V_{GS1}=V_{GS2}$ (assuming $I_{DS1}=0$).

Substituting equation (11) into equation (10) yields:

$$V_{GS1}-V_{Th}=(V_{DS0})+K(V_{DS0})^2-K[2(V_{DS0})-V_{DS1}]V_{DS1} \quad (12)$$

K may be expressed in terms of $V_{DS0}$ and a variable D (which is the maximum fractional increase in drain-source current above the reference value.) Letting D be defined as $KV_{DS0}$, then equation (12) may be rewritten as:

$$V_{GS1}-V_{Th}=(V_{DS0})[1+D]-D\left[2-\frac{V_{DS1}}{V_{DS2}}\right]V_{DS1} \quad (13)$$

Substituting equation (13) into equation (3) yields:

$$\frac{I_{DS1}}{k_1}=2(V_{GS1}-V_T)V_{DS1}-(V_{DS1})^2 \quad (14)$$

$$=2\left\{(V_{DS0})[1+D]-D\left[2-\frac{V_{DS1}}{V_{DS0}}\right]V_{DS1}\right\}V_{DS1}-(V_{DS.})^2$$

For D greater than or equal to 0 and $V_{DS0}$ greater than or equal to $V_{DS1}$, and $V_{DS1}$ greater than or equal to 0, equation (14) may be rewritten as:

$$\frac{I_{DS1}}{k_1}=D\frac{(V_{DS1})^3}{V_{DS0}}-[1+2D](V_{SD1})^2+2V_{DS0}[1+D](V_{DS1}) \quad (15)$$

Therefore, the output drain current $I_{DS1}$ ($I_{D0}$) of MOSFET MN1 may be rewritten as:

$$I_{DS1} = k_1 V_{DS1}\left[D\frac{(V_{DS1})^2}{V_{DS0}} - [1+2D](V_{DS1}) + 2V_{DS0}[1+D]\right] \quad (16)$$

To put this into perspective, it is useful to examine a number of particular cases. Considering first the output drain current at the transition (knee) voltage, the output current $I_{DS1}$ may be defined as:

$$I_{DS1}=k_1V_{DS0}[D(V_{DS0})-[1+2D](V_{DS0})+2V_{DS0}[1+D]] \quad (17)$$

where $V_{DS1}=V_{DS0}$, so that $$I_{DS1}=k_1(V_{DS0})^2[1+D]=I_{DS0}[1+D] \quad (18)$$

where $I_{DS0}$ is defined as $k_1(V_{DS0})^2$.

With any amount of feedback (D>0) the current at the transition voltage is larger than it would be without feedback. For a value of $V_{DS0}$ that is larger than the transition voltage $V_{DS0}$, the output MOSFET MN1 is in saturation and MOSFET MN3 is cut off (non-conducting), so the output drain current must return to its normal value $I_{DS0}$ (neglecting channel length modulation effects). As a consequence, the addition of the feedback circuit in accordance with the present invention causes the output drain current to increase, reaching a peak value at $V_{DS1}=V_{DS0}$. The percentage of peak is a function of feedback factor D. For a non-zero value of D, there is some drain-source voltage in the triode region that also has a value of $I_{DS0}$, where $I_{DS0}$ is previously defined.

$$\begin{aligned} I_{DS0} &= k_1(V_{DS0})^2 \\ &= k_1 V_{DS1}\left[D\frac{(V_{DS1})^2}{V_{DS0}} - [1+2D](V_{DS1}) + 2V_{DS0}[1+D]\right] \end{aligned} \quad (19)$$

or $$\begin{aligned} 0 &= V_{DS1}\left[D\frac{(V_{DS1})^2}{V_{DS0}} - [1+2D](V_{DS1}) + 2V_{DS0}[1+D]\right] \\ &\quad -(V_{DS0})^2 \end{aligned} \quad (20)$$

Dividing equation (20) by $(V_{DS0})^2$ yields:

$$0 = \left[\left[D\left(\frac{V_{DS1}}{V_{DS0}}\right)^3 - [1+2D]\left(\frac{V_{DS1}}{V_{DS0}}\right)^2 + 2\left(\frac{V_{DS1}}{V_{DS0}}\right)[1+D]\right] - 1 \quad (21)$$

This particular value of $V_{DS1}$ can be expressed as a fraction y of $V_{DS0}$, as follows:

$$0=Dy^3-[1+2D]y^2+2[1+D]y-1 \quad (22)$$

where y is the ratio of $V_{DS1}$ to $V_{DS0}$ at which $I_{DS1}=I_{DS0}$.

Rewriting equation (22) yields:

$$Dy^3 - 2Dy^2 + 2Dy = Y^2 - 2y + 1 \rightarrow D = \frac{Y^2 - 2y + 1}{y[y^2 - 2y + 2]} \quad (23)$$

Equation (23) is the relationship between the fraction of output drain current peaking above $I_{DS0}$ to the fraction of $V_{DS0}$, at which the current drops below $I_{DS0}$. For example, if the current sink current is to remain at or above $I_{DS0}$ for all drain source voltages down to 50% of $V_{DS0}$, then y=0.5. This makes D=0.4, so the current peaks at 40% above $I_{DS0}$. For this to happen, $R_1k_3$ must equal $D/V_{DS0}$. Table 1, shown in FIG. 4, lists these and other non-limiting values of y and D that may be employed.

It may be noted that at very low frequencies the current sink output impedance is relatively large—even into the low $V_{DS}$ range, because of the $V_{GS}$ feedback control loop. At frequencies above the bandwidth of the feedback loop and at low values of $V_{DS}$, the output impedance approaches $V_{DS}$ divided by $I_{DS0}$.

Due to the complex temperature coefficients of both $k_1$ and $V_{Th}$, the best correction may require that the value of the voltage dropping resistor R1 also be temperature dependent. In FIG. 3, the reference current and therefore the output current are temperature dependent (PTAT), while the resistance R1 has no temperature coefficient. Even under these conditions, the minimum usable overhead voltage is improved by 30% to 50%, or about 100 mV. The circuit of FIG. 1 is also operational at voltages below 100 mV at low temperatures, which compensates for the increase in the base-emitter voltage ($V_{BE}$) of bipolar junction transistors (not shown) that are biased by the output current $I_{DS1}$ of the current sink of FIG. 1.

As will be appreciated from the foregoing description, by coupling a feedback MOSFET in circuit with the output MOSFET of a current mirror-configured current source/sink circuit, and gate-coupling the output and reference MOSFETs through a voltage-dropping resistor, to which current generated by the feedback MOSFET is coupled, the low voltage MOSFET-configured current sink/source of the present invention is operative to compensate for a drop in the drain-source voltage of the output MOSFET, that would otherwise shift the operating point of the output MOSFET below its saturation region. In response to this drop in drain-source voltage of the output MOSFET, the feedback control MOSFET turns on, causing the flow of drain current in the feedback control MOSFET, which is then mirrored into a voltage drop across the gate-coupling resistor, and increasing the gate-source voltage applied to the output MOSFET. The effect of this increase in the value of the gate-source voltage of the output MOSFET for a reduced value of its drain-source voltage is to shift the saturation-linear transition region of its output current to a lower knee point, thereby reducing the amount of headroom voltage required of a given sink/source current at the output terminal.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein, but intend to cover all such changes and modifications as are obvious to one of ordinary skill in the art.

What is claimed:

1. A method of generating an output current comprising the steps of:

(a) providing a current mirror that contains a first current-generating device having a first input terminal, a first output terminal and a first control terminal, and a second current-generating device having a second input terminal, a second output terminal and a second control terminal, and wherein said first input terminal is coupled to a first voltage supply terminal, said first control terminal is coupled to said second control terminal, said second input terminal is coupled to said first voltage supply terminal, and said second output terminal is coupled to receive a reference current, and said first output terminal provides a prescribed output current in accordance with a first voltage applied across said first input terminal and said first output terminal for a second voltage applied across said first control terminal and said first input terminal; and (b) controlling the operation of said first current generating device so as to maintain said prescribed output current at said first output terminal in the presence of a change in said first voltage applied across said first input terminal and said first output terminal.

2. A method according to claim 1, wherein step (b) comprises, in the presence of said change in said first voltage applied across said first input terminal and said first output terminal, controllably modifying said second voltage applied across said first control terminal and said first output terminal to a value that is effective to maintain said prescribed output current.

3. A method according to claim 2, wherein step (a) comprises coupling said first control terminal to said second control terminal through a voltage-dropping circuit element that provides a voltage drop thereacross in response to current flow therethrough, and step (b) comprises coupling a third current-generating device in circuit with said first and second current-generating devices, and with said voltage-dropping circuit element, and causing said third current-generating device to supply current through said voltage-dropping circuit element, so as to modify said second voltage applied across said first control terminal and said first input terminal to a value that is effective to maintain said prescribed output current.

4. A method according to claim 3, wherein step (b) further comprises coupling a second current mirror circuit to said third current-generating device and to said voltage-dropping circuit element, and causing said second current mirror circuit to supply current through said voltage-dropping circuit element so as to modify said second voltage applied across said first control terminal and said first input terminal to a value that is effective to maintain said prescribed output current.

5. A method according to claim 2, wherein step (a) comprises coupling said first control terminal to said second control terminal through a voltage-dropping circuit element that provides a voltage drop thereacross in response to current flow therethrough, and wherein step (b) further comprises coupling a current feedback network in circuit with said first and second current-generating devices, and with said voltage-dropping circuit element, and causing said current feedback network to supply current through said voltage-dropping circuit element and modify said second voltage applied across said first control terminal and said first input terminal to a value that is effective to maintain said prescribed output current.

6. A method according to claim 5, wherein said current feedback network includes a second current mirror circuit containing a third current-generating device, coupled in circuit with said first and second current-generating devices and with said voltage-dropping circuit element, and wherein step (b) comprises, in response to said change in said first voltage applied across said first input terminal and said first output terminal, causing said third current-generating device to generate a current that is mirrored by said second current mirror circuit and applied to said voltage-dropping circuit element, so as to modify said second voltage applied across said first control terminal and said first input terminal to a value that is effective to maintain said prescribed output current.

7. A method according to claim 6, wherein said first current-generating device comprises a first field effect transistor having a first gate electrode, a first source electrode and a first drain electrode, said second current-generating device comprises a second field effect transistor having a second gate electrode, a second source electrode and a second drain electrode, and said third current-generating device comprises a third field effect transistor having a third gate electrode, a third source electrode and a third drain electrode, and wherein said first source electrode is coupled to said first voltage supply terminal, said first drain electrode is coupled to said first output terminal and to said third source electrode, and said first gate electrode is coupled to said second gate electrode through said voltage-dropping circuit element, said second drain electrode is coupled to receive said reference current, and said second source electrode is coupled to said first supply terminal and to said third gate electrode, and wherein said third drain electrode is coupled through said second current mirror circuit to said voltage-dropping element.

8. A method according to claim 7, wherein said first, second and third field effect transistors comprise MOSFETs of a first channel polarity, and wherein said second current mirror circuit is comprised of MOSFETs of a second channel polarity.

9. A method according to claim 7, wherein said voltage-dropping circuit element comprises a resistor.

10. A method according to claim 9, wherein said second current mirror and said resistor have temperature dependent characteristics.

11. A method according to claim 7, wherein said step (b) comprises adjusting said second voltage as said first voltage is changed to a value which varies operation of said first field effect transistor from a saturated operating region to a linear operating region, and maintains the value of drain current of said first field effect transistor above a reference value for a range of further change in said first voltage.

12. A low voltage MOSFET-configured current sink/source comprising an output node coupled to the drain of an output MOSFET, said output MOSFET being current mirror-coupled with a reference current MOSFET, said output MOSFET having its gate resistor-coupled to the gate of said reference current MOSFET and its drain coupled to the source a feedback control MOSFET of a feedback circuit containing a further current mirror circuit, said feedback control MOSFET having its gate electrode coupled to said reference current MOSFET, and being operative, in response to a drop in drain-source voltage of said output MOSFET that would otherwise cause said output MOSFET to shift from its saturation region to its linear region of operation, to turn on and thereby cause said further current mirror circuit to mirror drain current in said feedback control MOSFET through said resistor, thereby increasing the value of gate-source voltage of said output MOSFET to a value that effectively shifts the saturation-linear transition region of the drain-to-source current versus drain-source voltage of said MOSFET to a lower drain-to-source voltage range.

13. A circuit for coupling an output current comprising:

a current mirror containing a first current-generating device having a first input terminal, a first output terminal and a first control terminal, and a second current-generating device having a second input terminal, a second output terminal and a second control terminal, said first input terminal being coupled to a first voltage supply terminal, said first control terminal being coupled to said second control terminal, said second input terminal being coupled to said first voltage supply terminal, said second output terminal being coupled to receive a reference current, and said first output terminal providing a prescribed output current in accordance with a first voltage applied across said first input terminal and said first output terminal, for a second voltage applied across said first control terminal and said first input terminal; and a feedback circuit coupled in a feedback path with said first current-generating device and being operative to cause said first current-generating device to maintain said prescribed current in the presence of a change in said first voltage applied across said first input terminal and said first output terminal thereof.

14. A circuit according to claim 13, wherein said feedback circuit is operative, in the presence of said change in said first voltage across said first input terminal and said first output terminal, to controllably modify said second voltage across said first control terminal and said first output terminal to a value that causes said first current-generating device to maintain said prescribed output current.

15. A circuit according to claim 13, wherein a voltage-dropping circuit element is coupled between said first control terminal and said second control terminal, and wherein said feedback circuit is operative to supply a current through said voltage-dropping circuit element and thereby provide a voltage drop thereacross in the presence of said change in said first voltage across said first input terminal and said first output terminal, and thereby controllably modify said second voltage across said first control terminal and said first output terminal to a value that causes said first current-generating device to maintain said prescribed output current.

16. A circuit according to claim 15, wherein said feedback circuit includes a third current-generating device coupled in circuit with said first and second current-generating devices, and with said voltage-dropping circuit element, said third current-generating device being operative to provide a current that is coupled through said voltage-dropping circuit element, so as to modify said second voltage applied across said first control terminal and said first input terminal to a value that causes said first current-generating device to maintain said prescribed output current.

17. A circuit according to claim 16, wherein said feedback circuit further includes a second current mirror circuit coupled to said third current-generating device and to said voltage-dropping circuit element, and being operative to mirror a current generated by said third current-generating device through said voltage-dropping circuit element so as to modify said second voltage applied across said first control terminal and said first input terminal to a value that causes said first current-generating device to maintain said prescribed output current.

18. A circuit according to claim 17, wherein said first current-generating device comprises a first field effect transistor having a first gate electrode, a first source electrode and a first drain electrode, said second current-generating device comprises a second field effect transistor having a second gate electrode, a second source electrode and a second drain electrode, and said third current-generating device comprises a third field effect transistor having a third gate electrode, a third source electrode and a third drain electrode, and wherein said first source electrode is coupled to said first voltage supply terminal, said first drain electrode is coupled to said first output terminal and to said third source electrode, and said first gate electrode is coupled to said second gate electrode through said voltage-dropping circuit element, said second drain electrode is coupled to receive said reference current, and said second source electrode is coupled to said first supply terminal and to said third gate electrode, and wherein said third drain electrode is coupled through said second current mirror circuit to said voltage-dropping circuit element.

19. A circuit according to claim 18, wherein said first, second and third field effect transistors comprise MOSFETs of a first channel polarity, and wherein said second current mirror circuit is comprised of MOSFETs of a second channel polarity.

20. A circuit method according to claim 18, wherein said voltage-dropping circuit element and said second current mirror have temperature dependent characteristics.

21. A circuit according to claim 18, wherein said feedback circuit is operative to adjust said second voltage as said first voltage is changed to a value which varies operation of said first field effect transistor from a saturated operating region to a linear operating region, and maintains the value of drain current of said first field effect transistor above a reference value for a range of further change in said first voltage.

* * * * *